US010023371B2

(12) United States Patent
Calabrese et al.

(10) Patent No.: US 10,023,371 B2
(45) Date of Patent: Jul. 17, 2018

(54) PUSH TIE-TYPE FASTENER WITHOUT SURFACE PENETRATION

(71) Applicant: The Display Connection, Inc., Moonachie, NJ (US)

(72) Inventors: Stephen Calabrese, Leonia, NJ (US); Gary Licata, Woodridge, NJ (US); William Shopland, Montvale, NJ (US); Josh Urso, Jersey City, NJ (US)

( * ) Notice: Subject to any disclaimer, the term of this patent is extended or adjusted under 35 U.S.C. 154(b) by 0 days.

(21) Appl. No.: 15/280,018

(22) Filed: Sep. 29, 2016

(65) Prior Publication Data

US 2018/0086522 A1 Mar. 29, 2018

(51) Int. Cl.
*B65D 63/10* (2006.01)
*A44B 17/00* (2006.01)

(52) U.S. Cl.
CPC ..... *B65D 63/1027* (2013.01); *A44B 17/007* (2013.01); *A44B 17/0041* (2013.01); *A44B 17/0076* (2013.01); *B65D 2563/103* (2013.01)

(58) Field of Classification Search
CPC ..... B65D 63/1027; B65D 2563/103; A44B 17/0076; A44B 17/0041; A44B 17/007; F16B 13/0808; F16B 21/073; F16B 5/0642
USPC ..... 411/502, 510
See application file for complete search history.

(56) References Cited

U.S. PATENT DOCUMENTS 4,043,245 A * 8/1977 Kaplan ..... F16B 13/0808 411/346
4,075,924 A * 2/1978 McSherry ..... F16B 13/0808 411/112
6,126,372 A * 10/2000 Takata ..... F16B 15/0015 411/463
8,303,224 B2 * 11/2012 McDuff ..... F16B 13/003 411/341
2012/0186050 A1 * 7/2012 Justin ..... B65D 63/1072 24/457
2016/0206053 A1 * 7/2016 Mitsuo ..... A44B 17/0041

* cited by examiner

*Primary Examiner* — Robert Sandy
*Assistant Examiner* — Rowland Do
(74) *Attorney, Agent, or Firm* — Michael J. Feigin, Esq.; Feigin and Fridman

(57) ABSTRACT

A male connector having two (or more) tines or prongs extending from a joined surface or head is inserted into a female connector. This is accomplished by way of pushing the two tines into an entry portal of the female connector which, as the tines are pushed into the female connector, guides the tines away from each other and perpendicular to their direction of entry. The tines may have repeated triangular apexes on the surface, similar to a cable tie, while the female connector has oppositely-disposed triangular surfaces such that when the tines are pushed into the female member, they are irreversibly or substantially irreversibly held into the female connector.

5 Claims, 6 Drawing Sheets

PUSH TIE-TYPE FASTENER WITHOUT SURFACE PENETRATION

FIELD OF THE DISCLOSED TECHNOLOGY

The disclosed technology relates generally to connectors, and more specifically to a push connector adapted to fasten two items together, with legs of a male member exiting out the sides of the female member.

BACKGROUND OF THE DISCLOSED TECHNOLOGY

Cable ties are a creation of the Thomas & Betts Company who designed such ties in 1958 for airplane wire harnesses. These products are generally made out of plastic and have teeth angled such that they are pushable into a receptacle, the receptacle having indentations pointing inwards, such that teeth are pushable in one direction, but then lock or are more difficult to pull in the other direction. This keeps the cable tie attached to itself or to another connector.

Similarly, metal fasteners known in the art are used to fasten one item to another, such as the pushpin, thumbtack, grommet, clothespin, split pin, and brass fastener. These devices all serve to attach one item to another. The brass fastener functions by creating a hole with the fastener or before entry of the fastener, pushing the fastener through the holes, and separating the two legs of the fastener after passing through one or two layers/materials to be fastened together. Brass fasteners are typically procured from a soft metal (e.g., brass), allowing for separation of the two tines after penetration through the materials to be connected. This is similar to split pins which pass through a hole and then are separated after passing through.

While each of the above-described fastening devices has its uses in the art, most of them require puncturing, bending, or otherwise mutilating the fastener and/or at least one of the items being fastened. While fasteners are often inexpensive and easy to replace, the fact remains that one must continually buy new fasteners to replace the old. More problematically, though, the items being fastened often require hole punches, pinching, or puncturing by the fastener, thereby decreasing the life of the product being fastened or disabling the product from being connected and disconnected multiple times without damaging the product.

Needed in the art is a way to fasten items together strongly, in a repeatable manner which does not destroy or mutilate the items being fastened together or the fastener.

SUMMARY OF THE DISCLOSED TECHNOLOGY

A fastener of embodiments of the disclosed technology has a male member with tines connected to a head. A female member has a portal adapted to receive the tines of the male member. Flanges direct each of at least two tines in an opposite direction from one another which is further in a direction generally perpendicular to the direction of entry of the tines into the female member. The tines, or at least one of the tines, may have triangular teeth pointed towards the head of the male member. Further, the female member may have triangular teeth, such as one on each side (that is, one for each tine) on opposite and interior sides of the portal. The teeth of the tines and the teeth of the female member push past each other during entry, but become locked in place, preventing the disconnection or removal of the tines from the female member. Being "locked in place" or "substantially irreversible," for purposes of this disclosure, is defined as requiring excess force, at least an excess force of 10× the force required to adjoin the male and female members. That is, it takes at least 10× the force of joining the members to remove the members from one another. Being "irreversible"means that "more often than not, destruction or damage to a person or a connector will take place before or during removal of a male connector from a female connector."

Exit portals, in embodiments of the disclosed technology, are at right angles to the entry portal adapted to receive the tines. As such, two tines entering in parallel through the entry portal exit perpendicular to each other when exiting through the exit portals. Force pulling against tines extending through the exit portals causes a tine extending through a first exit portal to be removed from the female member when pulled at an angle to the direction of entry of the tines. When pulling the head in a direction which forms an acute angle with the entry portal, one tine will be pulled out of the entry portal while the other remains in place.

The entry portal has a square opening with two groups of oppositely disposed flanges extending into the square, in embodiments of the disclosed technology. These two groups of oppositely disposed flanges form two perpendicular lines of symmetry, such that any quarter of the square is identical (within a tolerance level accepted in the art) to any other quarter, so long as each quarter extends from a corner of the square. Two triangular teeth of the female member form a first oppositely disposed group of flanges, and said second group are the flanges which direct each of the two tines in an opposite direction from one another and further guide each tine of said two tines to abut a side and two corners of the square opening.

The female and male members may be attached to an elongated, flat surface (defined as at least 90% planar in at least a 25 cm radius from said tines, when flattened out by hand without the use of tools). Attachment of the male and female members to one another retains a solid structural integrity of the attached or pre-attached elongated, flat surfaces while fastening them together. That is, the attachment does not add further punctures or cause any other damage, either item being fastened by the fastener disclosed herein.

In embodiments, the connector has a base, side walls extending upwards from a top side of the base to a top side of the connector, and at least one exit portal in the side wall opening into a hollow interior space. An entry portal at the top side of the connector opens into the hollow space. At least one curvilinear flange extends inward from the side walls and is angled from a direction perpendicular to the entry portal to a direction perpendicular to the exit portal. As such, this curvilinear flange is adapted (positioned) to guide a flexible solid object (such as a tine) entering by way of the entry portal through a path in the hollow space and exit by way of the exit portal.

In the above embodiment, there may be an additional flange extending inward from the side wall into the path through which the tine is guided. This additional flange may be triangular (defined as forming two acute sides of a triangle or two sides joined at an apex), having two unequal length sides extending from the side wall. These two unequal length sides join at an apex and cause similar but opposite-sided triangular apexes on the tine to have to push past in order for the tine to enter, inhibiting the exiting thereof.

The connector may have two lines of symmetry at right angles to one another. As such, the at least one exit portal becomes two exit portals at opposite sides of each other.

DETAILED DESCRIPTION OF EMBODIMENTS OF THE DISCLOSED TECHNOLOGY

The disclosed technology described herein is a fastener with two parts. A first part of the fastener is similar to a brass fastener in that it has a head with two (or more) prongs extending from the head portion. These prongs are adapted to fit into a receptacle. Such a receptacle has flanges to direct each prong in an opposite direction from another prong, and perpendicular from the direction of entry. As such, the prongs, or tines, extend into an entry portal of the receptacle, containing the female member, and exit out the side through exit portals on either side of the female member. In this manner, the female member may be pre-fastened to a surface, article of clothing, display, bag, cardboard, plywood, or other equivalent surfaces or devices, and one may removably fasten other objects, by way of the male member extending into the female member, without penetrating through the female member or the surface or device to which the female member is attached.

Embodiments of the disclosed technology will become clearer in view of the following description of the drawings.

Figure 1:
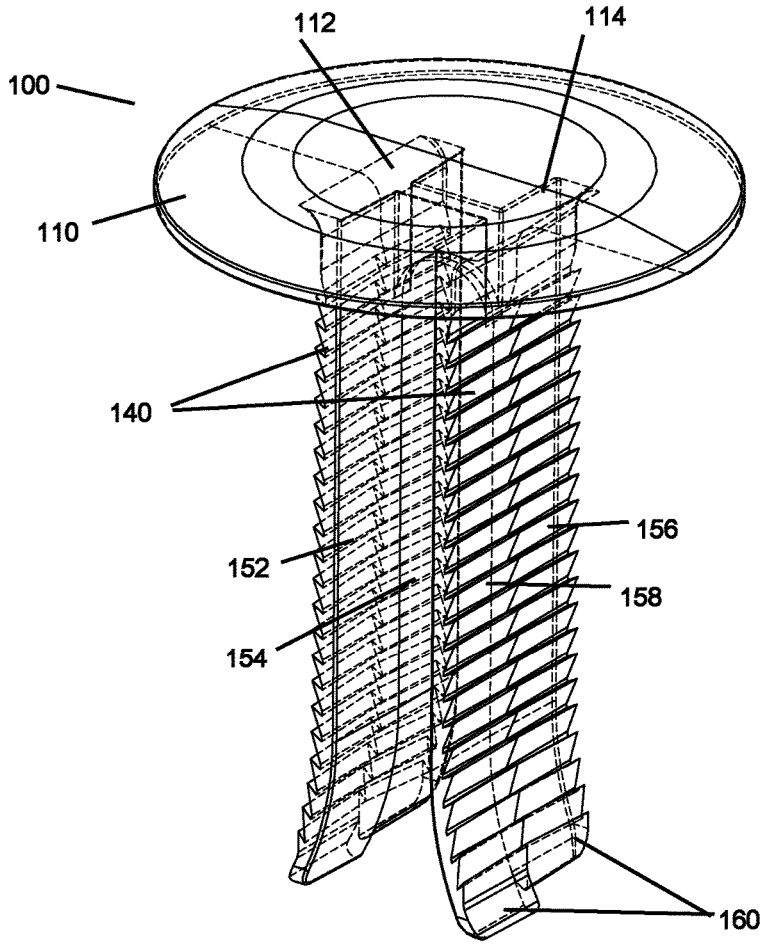
FIG. 1 shows a top and side perspective view of a male member of a fastening device of an embodiment of the disclosed technology.

FIG. 1 shows a top and side perspective view of a male member of a fastening device of an embodiment of the disclosed technology. The male member 100 has a head portion 110 which attaches to tines (prongs) at attachment points 112 and 114. The tines 140 are fixedly attached to, or form a unitary structure with, the head 110. The tines 140 extend away from the planar (or generally planar) underside of the head 110 in a perpendicular (or generally perpendicular) manner. For purposes of this disclosure, "generally" is defined as within an acceptable tolerance level known in the art or "at least 90%." The tines 140 are broken down into four individual tines, as shown: tines 152, 154, 156, and 158. As described, two tines (152 and 154) are adjacent to each other, and two are turned 180 degrees with respect to the first two (tines 156 and 158). It should be understood that in embodiments of the disclosed technology, tines 152 and 154 are fused together/are a single tine, and tines 156 and 158 are fused together/are a single tine. Note that the tines 140 have triangular wedges extending out from the outer surface of the tines.

In embodiments, the triangular wedges are not used, and, instead, the surface may be flat, jagged, or another pattern to either aid or prevent strong attachment when attached to the female member. The triangles wedges shown here are such that the two exposed sides of the triangular wedges are of unequal length, causing the apex of the triangle to point upward, towards the head 110. This allows the triangles to be easily pushed down past another triangle, but makes them more difficult to remove or irreversible (defined as at least 10× more force required to remove than to connect), as during removal, the short sides of triangles abut each other at more obtuse angles rather than sliding past, as is the case with two long sides of triangles which are at lesser opposing angles with respect to one another. The ends 160 of the tines, in embodiments, are of different lengths and/or flare outwards to help make the connection of the male member 100 to the female member 200 (see FIG. 2) easier to accomplish.

Figure 2:
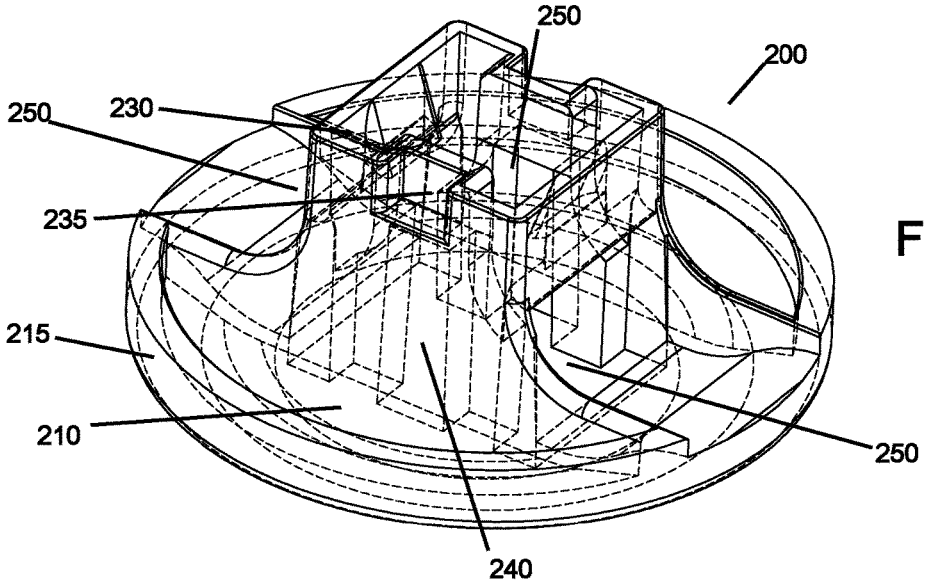
FIG. 2 shows a top and side perspective view of a female member of a fastening device of an embodiment of the disclosed technology.

FIG. 2 shows a top and side perspective view of a female member of a fastening device of an embodiment of the disclosed technology. The female member 200 has a passageway 250 extending from between a top portal, defined by the top walls 232 thereof, leading through, towards, or to the bottom surface 210 of the base of the female member. Side walls 230 extend from the base 210 to the top walls 232, which define the upper or entry portal. The passageway 250 further has an exit portal extending out of each side of the sidewalls 240 of the device. The sidewalls 240 extend from the base 210 of the female member 200 up towards the top portal walls 232, which is defined by the walls 240, with the two exit portals on either opposite side, cut into the walls 240. The base further has a lip 215, and top side 205, which are viewable in FIG. 3. The exit portals are each defined by a plate of the portal 250, which is bordered by both the side walls 230 and bottom surface 210 of female member 200. As such, as shown in FIG. 2, there are two exit portals, one on each side (opposite sides) of the female member 200, shown as openings into the housing or lacking in the sidewalls 230.

Figure 3:
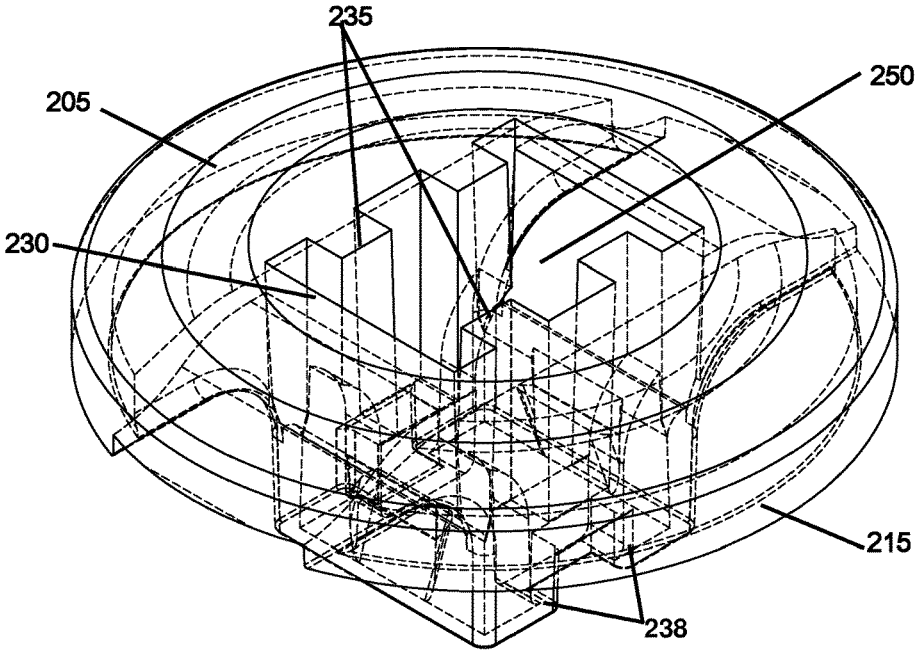
FIG. 3 shows a bottom and side perspective view of a female member of a fastening device of an embodiment of the disclosed technology.

FIG. 3 shows a bottom and side perspective view of a female member of a fastening device of an embodiment of the disclosed technology. The top side 205 of the base (female member) 200 is affixed or pre-affixed to an object to be attached. in embodiments of the disclosed technology. This may be forming a unitary structure between a generally elongated surface of an object and the base, screwing or gluing the base to such a surface, or clipping or otherwise attaching the base to such a surface. The generally elongated surface is a surface of an item to be attached to another, the other item forming a structure, in any of the above-described manners, with the male member 100. The male member 100 may also be inserted through a hole or portal in an elongated surface (such as a piece of cardboard, fabric, or other object, as described in the background) before being attached to the female member 200.

Referring still to FIG. 3, the portal 250 extends through the female member 200, though in other embodiments, it is closed off at this top side 205. The rectangular portal 250 is defined by the side walls 230 with protrusions breaking into the geometric rectangular shape, in the interior thereof. Such protrusions 238 guide the tines 140 of the male member 100 to the corners of the portal 250. A single corner 239 is labeled in FIG. 3 for clarity. This corner 239 is one of four corners of the rectangular portal formed by the sidewalls 230, especially at the top portion 232 thereof, which has the protrusions 238 there-in. Arrow 310 shows the path of at least one tine through portal 250. The tine—here, tines 158 and 156—is pushed through the top of the housing and guided to the extreme side (here, extreme left side) of the portal 250, touching, abutting, or between the side wall (where the line extending from the label 232 terminates) and the near set of inward protrusions/flanges 238. The tines exit out the side of the female member, as indicated by the arrow 310.

Referring to FIGS. 2 and 3 simultaneously, the inward protrusions/flanges 238 form a unitary structure with the inward flange 235. That is, on each side of the device, there is an inward flange 235 which bifurcates into two flanges 238 as one travels towards the base 210 of the device. This is in a curvilinear manner to direct a tine entering at the top portal (between the top walls 232) towards the side of the device, and out an exit portal.

Figure 4:
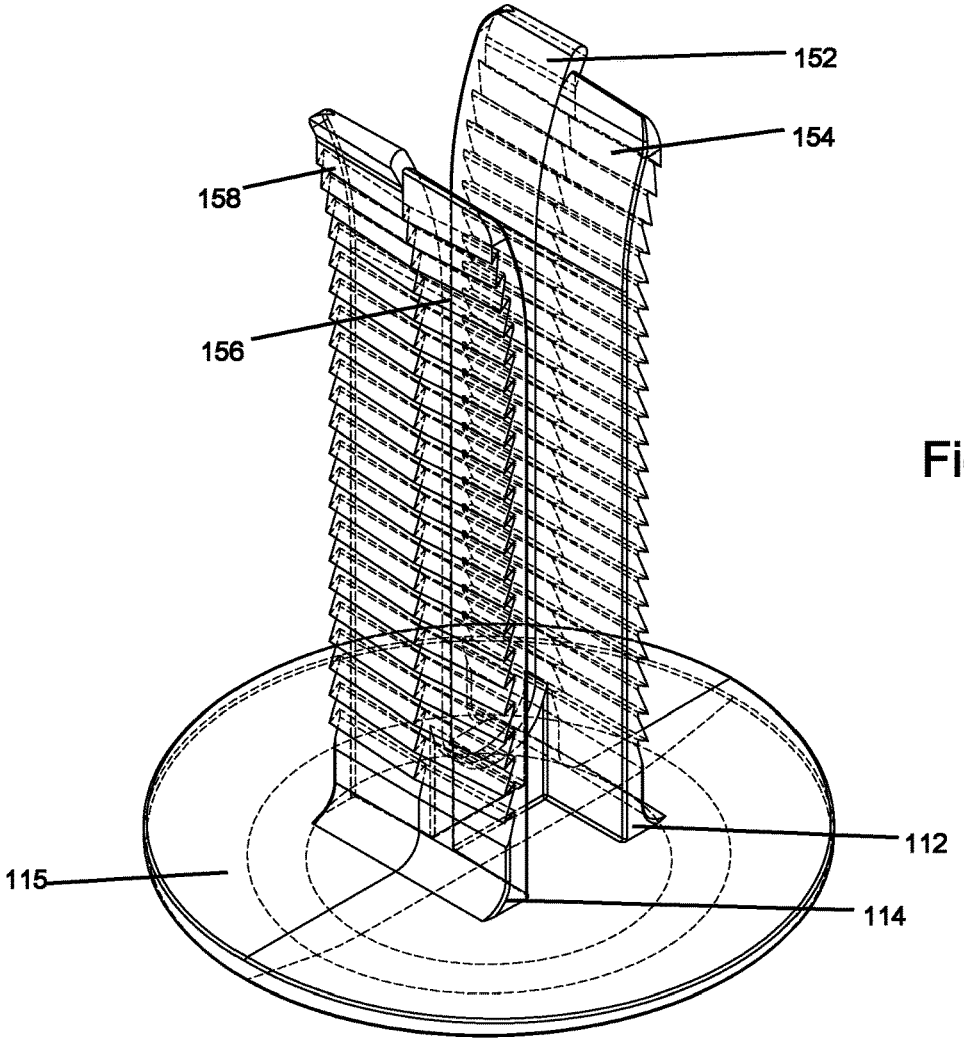
FIG. 4 shows a bottom and side perspective view of a male member of a fastening device of an embodiment of the disclosed technology.

FIG. 4 shows a bottom and side perspective view of a male member of a fastening device of an embodiment of the disclosed technology. Here, the triangular repeating pattern on the tines is clearly seen with a longer side below each triangular/acute apex and a shorter side above each triangular/acute apex. When pushed past a flange/protrusion in the female member, the tine locks in place. Further, by having the tine extend in a generally perpendicular manner, once in the female member, the triangular apexes become more strongly locked around (defined as "requiring greater force to remove or undo") the flange within the female member. "Generally perpendicular" and "perpendicular," for purposes of this disclosure, are defined as having a first portion of a tine or prong between the entry to the portal 250 and head 110, and second portion of the tine or prong between the exit of the port 250 and the extreme end 160 of the tine being perpendicular to each other, with an additional curvilinear portion of the tine. In this manner, a tine, or other flexible solid material entering through the top entry portal is guided towards the exit portal. In FIG. 4, one can also see the bottom 115 of the head and the attachment areas 112 and 114 where the tines attach to the generally planar bottom 115 of the head.

Figure 5:
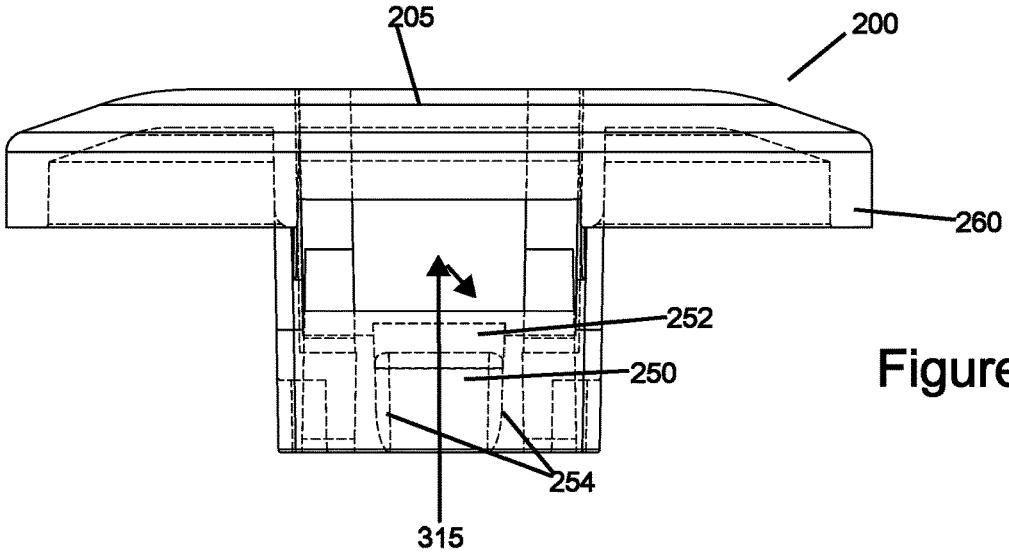
FIG. 5 shows a side elevation view of a female member of a fastening device of an embodiment of the disclosed technology.

FIG. 5 shows a side elevation view of a female member of a fastening device of an embodiment of the disclosed technology. Arrows 215 denote the path of a tine through a portal 250. Walls 254 represent the sides of an entry portal defined as the portal 250. On the opposite side, another tine, or group of tines, may enter, as a mirror image of what is shown, and simultaneous to the entry of tines along path 310. The portal 250 is further cut into by at least one triangular apex 252. The triangle 252 comprises two acute sides meeting at an apex, similar to those on the tines, as described above. In embodiments, the shorter side of the triangle/side of the apex of the flange 252 and on the tines face each other when a tine enters the portal 250, in order to allow the tines to move more easily into the female member 200 than being removed there-from.

Figure 6:
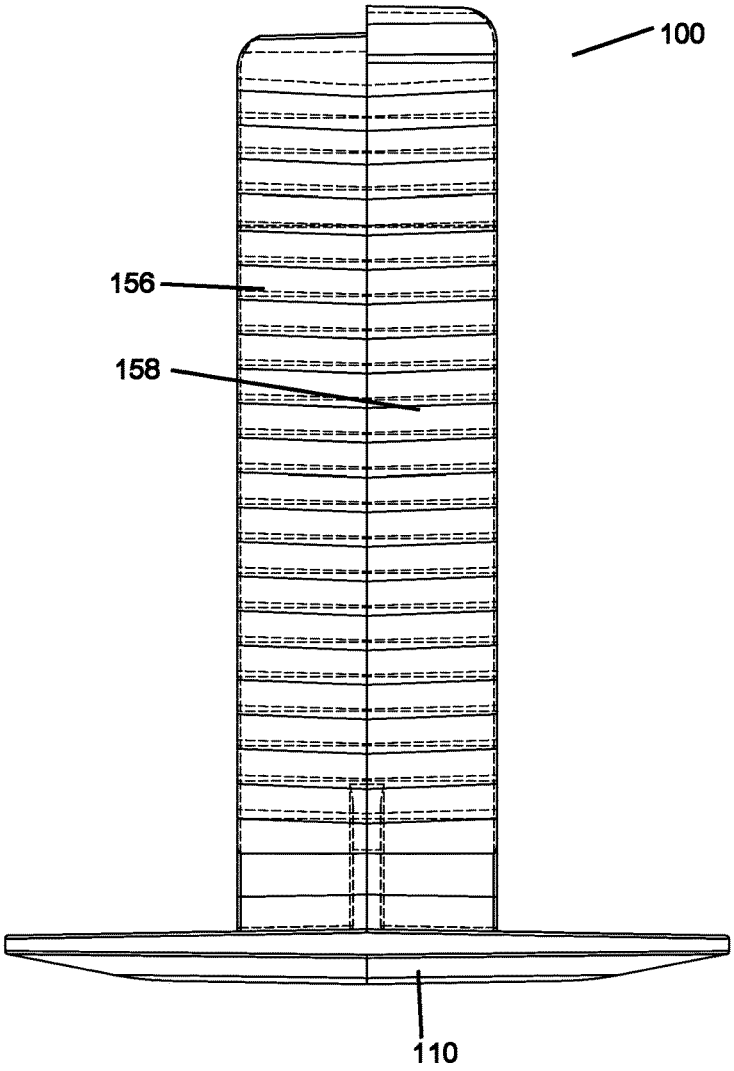
FIG. 6 shows a side elevation view of a male member of a fastening device of an embodiment of the disclosed technology.
Figure 7:
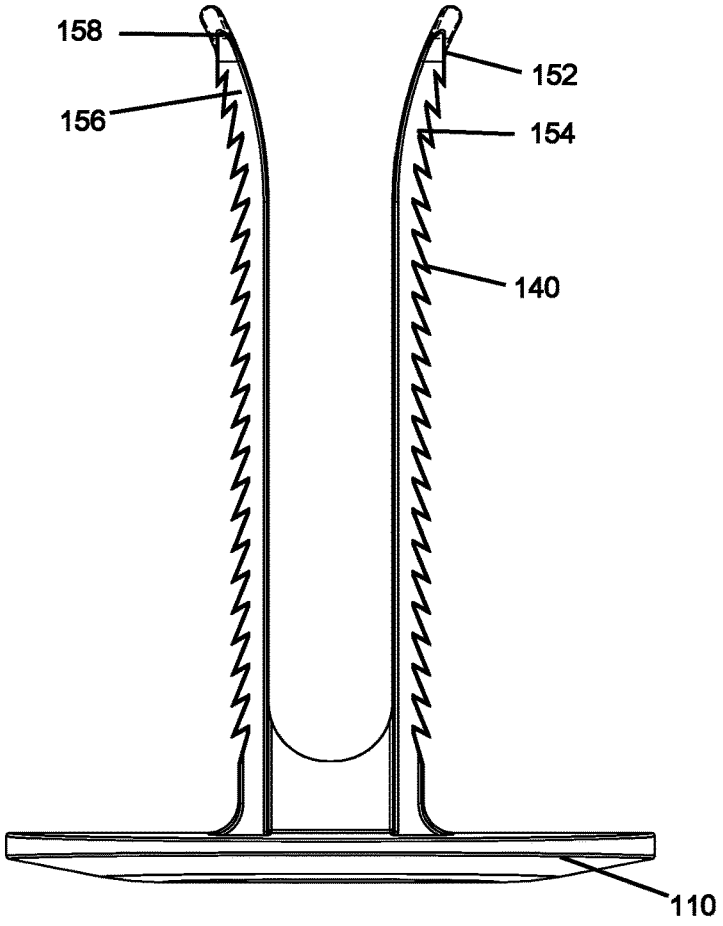
FIG. 7 shows a side elevation view of a male member of a fastening device turned 90 degrees compared to the view of FIG. 4, of an embodiment of the disclosed technology.
Figure 8:
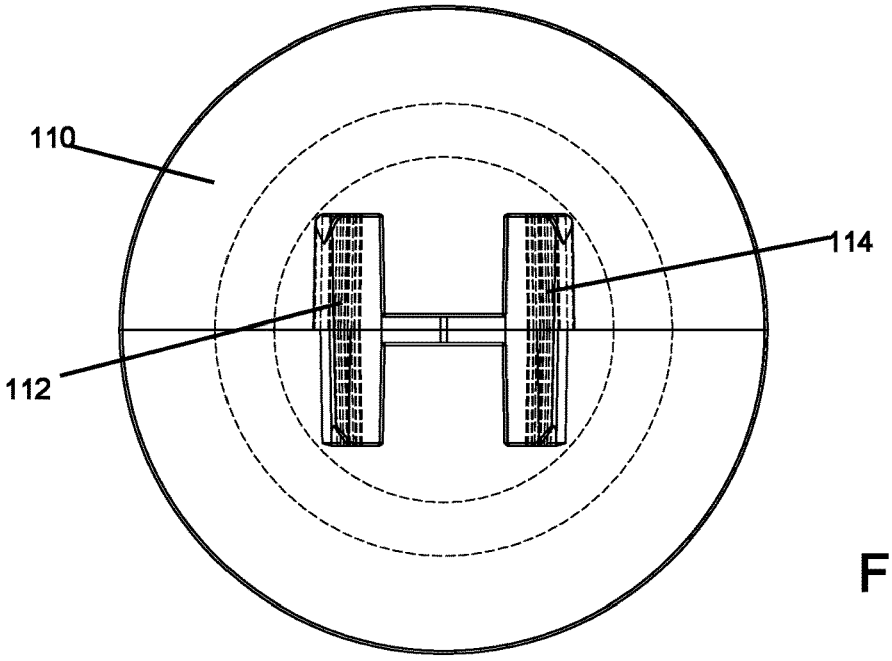
FIG. 8 shows a top view of a male member of a fastening device of an embodiment of the disclosed technology.

FIG. 6 shows a side elevation view of a male member of a fastening device of an embodiment of the disclosed technology. FIG. 7 shows a side elevation view of a male member of a fastening device turned 90 degrees compared to the view of FIG. 4, of an embodiment of the disclosed technology. FIG. 8 shows a top view of a male member of a fastening device of an embodiment of the disclosed technology. The descriptions above, describing the elements shown in these figures. are applicable to FIGS. 6, 7, and 8.

Figure 9:
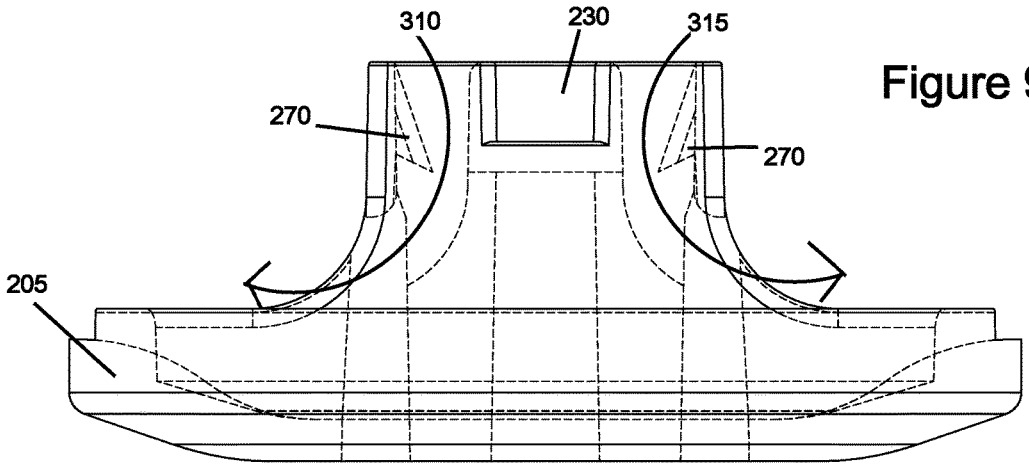
FIG. 9 shows a side elevation view of a female member of a fastening device of an embodiment of the disclosed technology.

FIG. 9 shows a side elevation view of a female member of a fastening device of an embodiment of the disclosed technology. In this view the triangular flanges 252 extending into the portal 250 on either side of the female member 200 are clearly seen. The arrows 310 and 315 represent the paths of tines into the portal, on sides of the portal, and their path away from the sides perpendicular to the direction of entry. Two triangular teeth 270 (also referred to as the triangular apex, as in FIG. 5) are on opposite and interior sides of the portal adapted to abut the triangular teeth of the male member.

Figure 10:
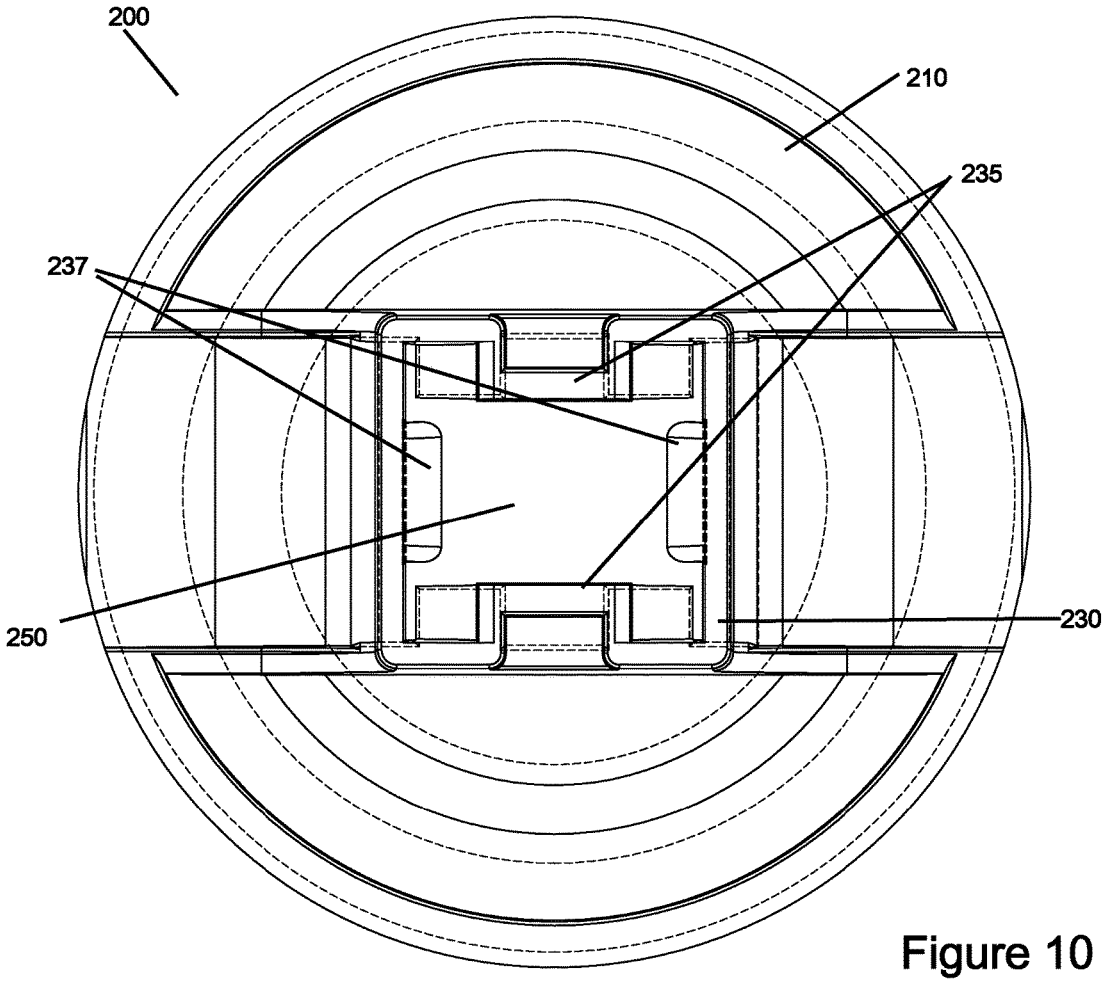
FIG. 10 shows a top view of a female member of a fastening device of an embodiment of the disclosed technology.
Figure 11:
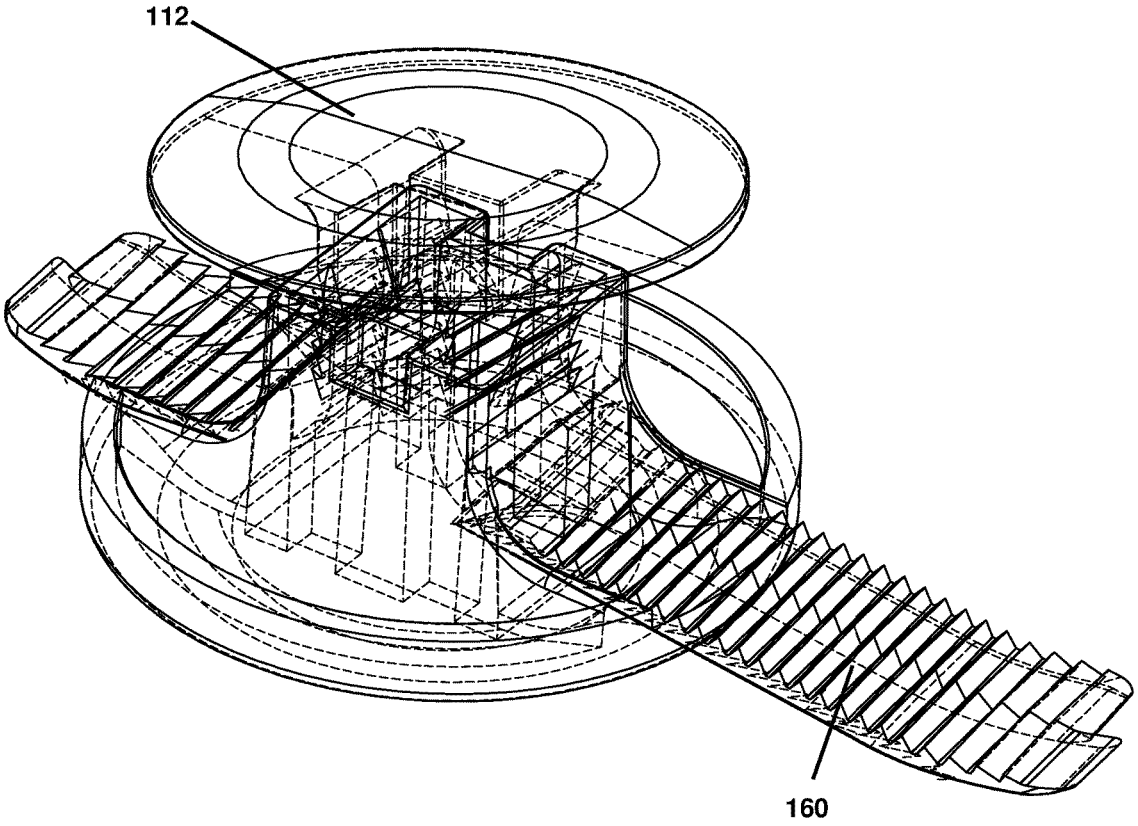
FIG. 11 shows a top and side perspective view of a male member of a fastening device inserted into a female member in an embodiment of the disclosed technology.

FIG. 10 shows a top view of a female member of a fastening device of an embodiment of the disclosed technology. Here, one can see directly into the portal 250. The entry portal is defined by the walls 232, and inward flanges 235 on either side extending into the rectangular area forming an H-shape at the top of the device (the plane of entry of the tines). This is referred to synonymously in this disclosure as a "rectangle with inward flanges" or "H-shape." In embodiments, the rectangle is additionally a square. Further describing the entry portal, this portal has corners, such as corner 239. The tines enter the portal 250 at this point of entry traveling down (into the plane of the page on which FIG. 10 is viewed) along the arrows 310 and 315, and then continue perpendicularly, following the respective arrows 310 and 315 pointing out of the device, from the exit portals. In the process, the tines pass another inward pointing flange 252 (triangle or apex). As each triangle or apex of the tines pushes past its counterpart 252 in the female member, the tine becomes locked in place, having easier movement inwards than outwards. Though one can angle the tines and remove one-side at a time, pulling the head 110 of the male member (or tines 140) directly away from the female member 120 is quite difficult, making the tines substantially irremovable.

In FIG. 10, the inward flanges 238 on the bottom side (closer to the base 210 than the opening to the portal at the top) are also viewable. The inward flanges 238 form a unitary inward flange with respective inward flanges 235, and serve to guide the tines to the sides of the portal 250 and out the exit portals on the side. That is, two flanges 238 on the same side of the inside walls 230 are joined together by a unitary flange 235 connecting them, such that the tines passing through pass close to the sidewalls and then out of each respective exit portal. As described above, when the tines pass through the entry portal between the side walls of the portal 330 and the flanges 235 (at the left and right sides, when looking down from the top, as shown in FIG. 10), the triangles of the tines 140 successfully bounce or push over and past a or the flanges 252, locking the tines from reverse (exiting) movement.

In embodiments of the disclosed technology, the male connector 100 and female connector 200 have lines of symmetry where opposite sides thereof are mirror images of each other. The male connector may have at least two lines of symmetry, each of which cuts the head section 110 in half. A first of these two lines of symmetry further cuts the tines in half. A second of these two lines of symmetry is offset 90 degrees from the first line, cutting the head section 110 in half and placing a tine or set of tines on each side of the line of symmetry. Diagonal lines of symmetry, offset 45 degrees from the first two described lines of symmetry, may also exist.

For the female connector 200, lines of symmetry are similar to those of the male connector. When viewing the female connector from the top, as in FIG. 10, the lines of symmetry may be drawn on this figure as a centered vertical line or a centered horizontal line. Again, diagonal lines of symmetry, 45 degrees offset from the vertical and horizontal, also exist. In this manner, what happens on one side of the line of symmetry also may happen on the other, such as the joint insertion of tines on either side of the female connector in a mirrored manner.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

We claim:

1. A fastener, comprising:

a male member with at least two tines connecting to a head;

a female member with an entry portal adapted to receive said at least two tines; and flanges directing each of said two tines in an opposite direction from one another and in a direction generally perpendicular to the direction of entry of said tines into said female member;

wherein at least one tine of said tines comprises triangular teeth pointed towards said head of said male member wherein said female member comprises at least two triangular teeth with at least one triangular tooth on opposite and interior sides of said portal adapted to abut said triangular teeth of a said at least one tine of said tines, wherein said female member further comprises exit portals, each exit portal at a right angle to said entry portal adapted to receive said at least two tines, wherein said portal adapted to receive said at least two other tines further comprises:

a square opening with two groups of oppositely disposed flanges extending into said square arranged along two perpendicular lines of symmetry;

wherein at least two of said triangular teeth of said tines form a first oppositely disposed group of flanges, and a second group of oppositely disposed flanges are said flanges directing each of said two tines in an opposite direction from one another and further guide each tine of said two tines to abut a side and two corners of said square opening.

2. The fastener of claim 1, wherein said female member is fixedly attached to an elongated, flat surface, and attachment of said male member to said female member is accomplished while retaining a solid and unbroken characteristic of said elongated, flat surface.

3. The fastener of claim 2, wherein said head of said male member is a further elongated, flat surface pre-attached to said tines, and attachment of said male member to said female member is accomplished while retaining a solid and unbroken characteristic of said further elongated, flat surface.

4. A fastener comprising:

a male member with at least two tines connecting to a head;

a female member with an entry portal adapted to receive said at least two tines;

flanges directing each of said two tines in an opposite direction from one another and in a direction generally perpendicular to the direction of entry of said tines into said female member;

at least two other tines extending parallel to each other through said entry portal adapted to receive, and extending in opposite directions to one another through respective said exit portals;

wherein at least one tine of said tines comprises triangular teeth pointed towards said head of said male member wherein said female member comprises at least two triangular teeth with at least one triangular tooth on opposite and interior sides of said portal adapted to abut said triangular teeth of a said at least one tine of said tines wherein said female member further comprises exit portals, each exit portal at a right angle to said entry portal adapted to receive said at least two tines; and wherein a force pulling said head of said male member away from said female member at an angle acute to said entry portal of said female member causes tines extending through a first exit portal of said exit portals to exit from said entry portal of said female member, while tines extending through a second exit portal of said exit portals remain in place, with respect to said female member.

5. The fastener of claim 4, wherein said tines, extending through said at least two exit portals, are locked in place when pulling said head in an opposite direction from said female member.

* * * * *